US008596259B2

(12) United States Patent
Padgett et al.

(10) Patent No.: US 8,596,259 B2
(45) Date of Patent: Dec. 3, 2013

(54) HIGH EFFICIENCY BURNER

(75) Inventors: Michael Padgett, Austin, KY (US); John Pottenger, Hendersonville, TN (US); William M. Pryor, Portland, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 198 days.

(21) Appl. No.: 12/685,818

(22) Filed: Jan. 12, 2010

(65) Prior Publication Data

US 2010/0175683 A1 Jul. 15, 2010

Related U.S. Application Data

(60) Provisional application No. 61/144,335, filed on Jan. 13, 2009.

(51) Int. Cl.
*F24C 3/00* (2006.01)

(52) U.S. Cl.
USPC ..... 126/39 E; 126/39 R; 431/278; 431/286; 431/354

(58) Field of Classification Search
USPC ..... 126/39 E, 39 R; 239/552, 556, 558; 431/278, 285, 286, 354
See application file for complete search history.

(56) References Cited

U.S. PATENT DOCUMENTS

| | | | |
|---|---|---|---|
| 2,099,205 | A | 11/1937 | Harper et al. |
| 2,220,247 | A | 11/1940 | Kochendorfer et al. |
| 2,337,240 | A | 12/1943 | Harper et al. |
| 3,796,535 | A | 3/1974 | De Gouville |
| 4,938,687 | A | 7/1990 | Monteil |
| 5,649,822 | A | 7/1997 | Gertler et al. |
| 6,135,764 | A | 10/2000 | Kwiatek |
| 6,263,868 | B1 | 7/2001 | Koch et al. |
| 6,607,378 | B2 | 8/2003 | Harneit et al. |
| 6,679,699 | B2 | 1/2004 | Yam et al. |
| 6,764,303 | B2 | 7/2004 | Dane et al. |
| 2008/0202495 | A1 | 8/2008 | Caloca et al. |
| 2009/0205630 | A1 | 8/2009 | Pottenger et al. |
| 2010/0175683 | A1 * | 7/2010 | Padgett et al. ..... 126/39 E |

FOREIGN PATENT DOCUMENTS

| | | |
|---|---|---|
| DE | 130924 | 5/1902 |
| EP | 0609502 | 8/1994 |
| FR | 1291052 | 4/1962 |
| GB | 196758 | 5/1923 |

OTHER PUBLICATIONS

International Search Report for PCT/US2010/020853, dated Jun. 11, 2010, 3 pages.

* cited by examiner

*Primary Examiner* — Alfred Basichas
(74) *Attorney, Agent, or Firm* — Pearne & Gordon LLP

(57) ABSTRACT

A gas burner for an appliance includes a base and a cover. The base includes a wall peripherally formed about the base. The wall includes a plurality of slits extending through the wall and downwardly from a top of the wall. A cover is configured to be placed on the base and form a chamber in fluid communication with a gas conduit. The cover is configured to bound the slits to define a plurality of ports for releasing combustible gas exteriorly of the gas burner. The ports include an entry section near the inner surface and an exit section near the outer surface. Each of the slits includes a floor that is curved upwards from the entry section to the exit section.

22 Claims, 3 Drawing Sheets

HIGH EFFICIENCY BURNER

CROSS-REFERENCE TO RELATED APPLICATIONS

This application claims the benefit of U.S. Provisional Application No. 61/144,335, filed Jan. 13, 2009, the entire disclosure of which is hereby incorporated herein by reference.

FIELD OF THE INVENTION

The present invention relates generally to gas burners, and more particularly, to gas burners with flame ports from which combustible gas exits.

BACKGROUND OF THE INVENTION

Cooktops equipped with a plurality of gas burners are well known in the art. Each gas burner is generally fitted with a corresponding grate to support a cooking vessel to be heated at a distance above the gas burner. Combustible gas generally exits the gas burner in a peripherally scattered manner and the flames from the gas burners are directed in a substantially outward direction once the combustible gas is ignited.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its purpose is to present some concepts of the invention in a simplified form as a prelude to the more detailed description that is presented later.

In accordance with an example of the present invention, a gas burner for an appliance includes: a chamber peripherally defined by a wall, the wall including a plurality of ports that extend therethrough and are configured to release combustible gas exteriorly of the gas burner, the ports including an entry section and an exit section for combustible gas, each of the ports including a floor, the floor having a surface that curves upwardly from the entry section to the exit section.

In accordance with yet another example, a gas burner for an appliance includes: a base including a wall peripherally formed about the base, the wall including an inner surface, an outer surface and a plurality of slits extending through the wall; and a cover configured to be placed on the base and form a chamber in fluid communication with a gas conduit, the cover configured to bound the slits to define a plurality of ports for releasing combustible gas exteriorly of the gas burner, wherein the ports include an entry section near the inner surface and an exit section near the outer surface, and wherein each of the slits includes a concave-shaped floor between the entry section and the exit section.

In accordance with yet another example, a gas burner for an appliance includes: a base including a crenellated wall peripherally formed about the base, the wall including an inner surface and an outer surface and further including crenels and merlons arranged in an alternating manner along the wall, the crenels extending through the wall and downwardly from a top of the wall; and a cover configured to be placed on the base and form a chamber in fluid communication with a gas conduit, the cover configured to bound the crenels to define a plurality of ports for releasing combustible gas exteriorly of the gas burner, wherein the ports include an entry section and an exit section, and the crenels include a floor such that a first acute angle formed by a tangent to the floor at the exit section with a horizontal plane is greater than a second acute angle formed by the tangent to the floor at the entry section with the horizontal plane.

BRIEF DESCRIPTION OF THE DRAWINGS

The foregoing and other aspects of the present invention will become apparent to those skilled in the art to which the present invention relates upon reading the following description with reference to the accompanying drawings.

DESCRIPTION OF EXAMPLES OF EMBODIMENTS

Figure 1:
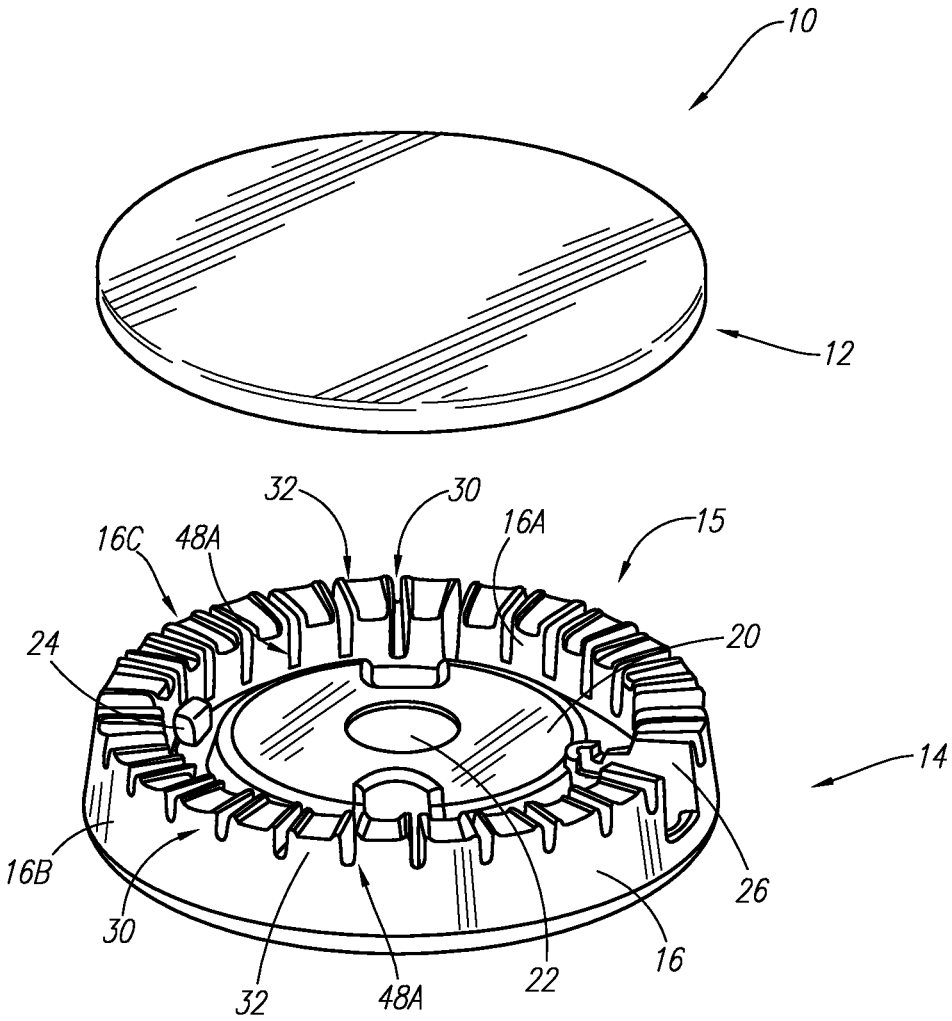
FIG. 1 is an exploded view of a gas burner in accordance with the present invention and shows a cover and a base.

Examples of embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

The gas burners shown and described herein are generally referred to as a type that is usually seen on a home appliance such as a cooktop of a stove. However, the term "gas burner" should be construed to include any apparatus with means for igniting the gas upon release from a storage/channeling means and may be embodied as part of, but is not limited to, an outdoor or portable stove, an oven, a grill, a lamp, a lantern, a heater, a furnace, a fireplace, a kiln or the like. Variations in the manner that the combustible gas exits the burner can result in differences in efficiency or efficacy of the gas burner resulting in a shorter heating time. For example, it may be possible to reach a boiling point more quickly at the same volume rate of gas supply using a different structure for the gas burner.

Turning now to FIG. 1, an example gas burner 10 is shown. The gas burner 10 includes a cover 12 and a base 14 that combine to form a chamber 15 to which combustible gas is supplied. This embodiment of the gas burner 10 has circular bases and is cylindrical and, more specifically, in a truncated cone shape although other variations in shape are also contemplated by this invention. For example, other embodiments of the gas burner may include oval or substantially rectangular bases. The cover 12 is a substantially planar cap that is configured to suitably fit the base 14. The cover 12 may include a top surface and a bottom surface.

Figure 2:
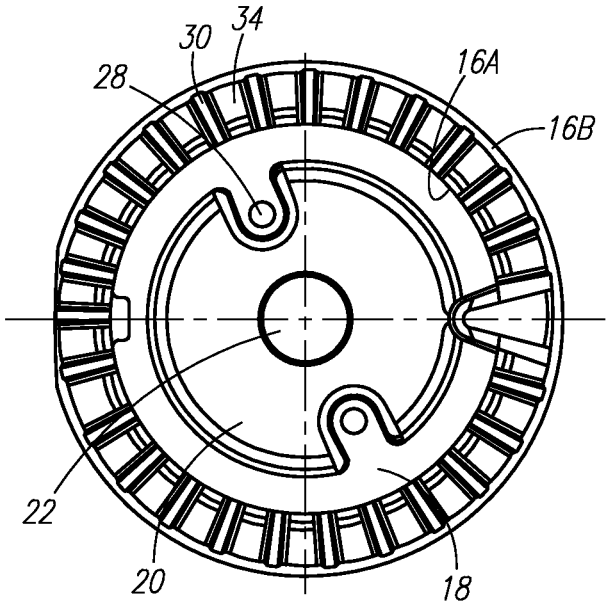
FIG. 2 is a top view of the base showing a plurality of flame ports along a side wall.

The base 14 may include a bottom wall 18 and an annular side wall 16 which is peripherally formed about the bottom wall 18. The bottom surface of the cover 12 may include an annular rim that is slightly smaller in diameter than an annular side wall 16 of the base 14 so as to snugly fit interiorly of the side wall 16. The side wall 16 includes an inner surface 16*a*, an outer surface 16*b* and a top 16*c* on which the cover 12 can be placed. The cover 12 is dimensioned such that, by placing the cover 12 on the base 14, the chamber 15 is formed and is substantially bounded by the bottom wall 18 and the side wall 16 of the base 14 and the bottom surface of the cover 12. As shown in FIGS. 1 and 2, the bottom wall 18 may include a substantially annular projection 20 and a central opening 22 which is in communication with a combustible gas source and through which combustible gas is supplied to the chamber 15. The base 14 is substantially symmetrical about a central axis of the base 14 except at an igniter 24 and at an optional stability chamber 26. The bottom wall 18 may also include apertures 28 by which the base 14, and the gas burner 10, is secured to the appliance through fastening means known in the art such as screws, nuts/bolts or the like. The combustible gas that enters through the central opening 22 is confined to the chamber 15 prior to exiting the chamber 15 through flame ports, vents or the like formed on the side wall 16 of the base 14 as will be described in the following.

The base 14 and the cover 12 may be made of material selected based on factors such as heat-resistance, corrosion or longevity such as metals, ceramics, or the like.

Figure 3:
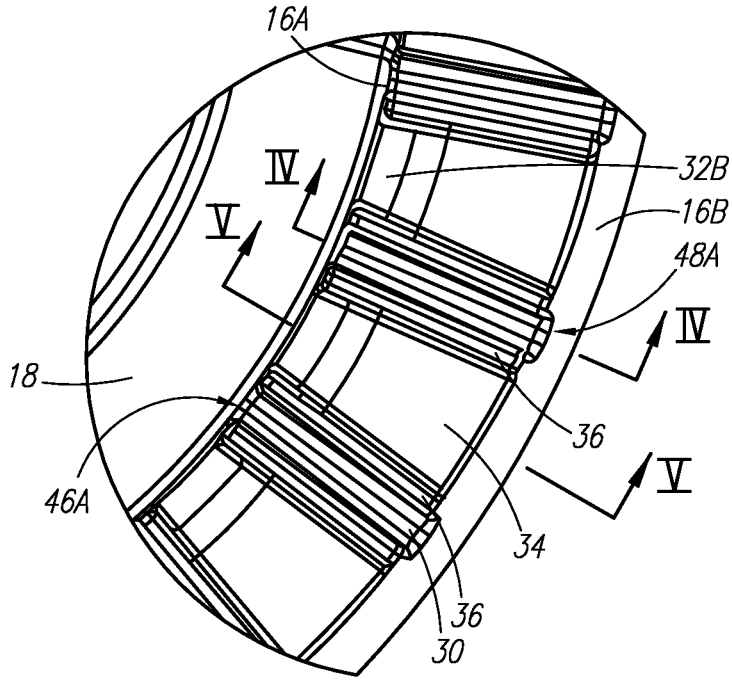
FIG. 3 is a close-up view of the side wall showing flame ports.
Figure 4:
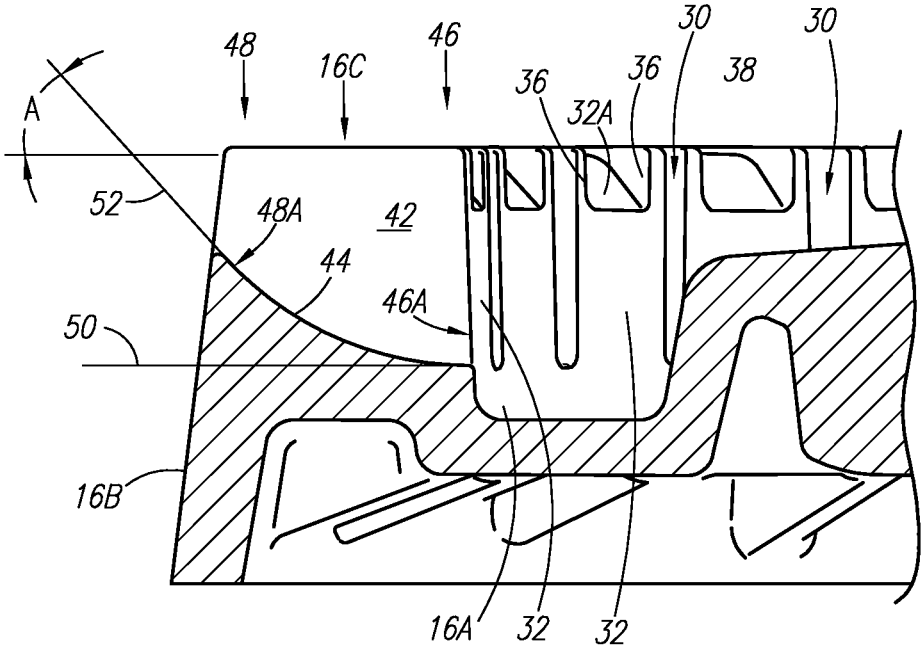
FIG. 4 is a cross-sectional view taken along line IV-IV in FIG. 3 showing a first type of flame port.
Figure 5:
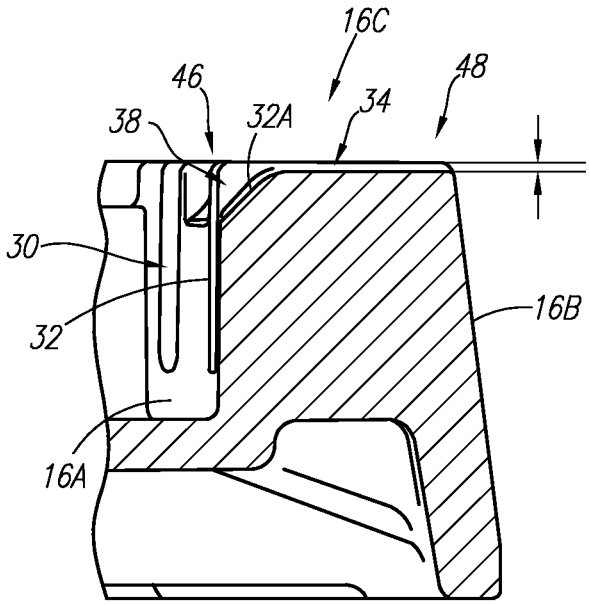
FIG. 5 is a cross-sectional view taken along line V-V in FIG. 3 showing a second type of flame port.

As shown in FIGS. 3-5, the shape of the side wall 16 may be described as crenellated in that the side wall 16 includes crenels 30 and merlons 32 that are arranged in an alternating manner along the side wall 16 and in a scattered manner about the periphery of the gas burner 10. The crenels 30 are equally sized as are the merlons 32 although this is not required. At the top of each merlon 32, a substantially horizontal slit 34 may be formed such that a gap exists between the top of a merlon 32 and the bottom surface of the cover 12 when the cover 12 is placed on the base 14. In such an embodiment, the cover 12 is supported by the lateral columns 36 formed at the top of the merlon 32. On the interior end of the horizontal slit 34, the inner surface 16*a* of the merlon 32 includes a chamfer 32*a* that forms an entry area 38. For example, the chamfer 32*a* may be at a 44.5-degree angle. The horizontal slits 34 function as a set of flame ports through which combustible gas may flow out of the chamber 15. In this embodiment, the horizontal slits 34 are shaped in segments of an arc and gradually widen in radial directions.

The crenels 30 also act as a set of flame ports through which combustible gas may flow out of the chamber 15. In this embodiment, the crenels 30 are substantially vertical slits that extend through the side wall 16 from the chamber 15 to the exterior of the gas burner 10 in radial directions. The crenels 30 are substantially defined by the bottom surface of the cover 12, the side faces 42 of the neighboring merlons 32 and a floor 44 between the merlons 32. Although the floor 44 is narrow, the floor 44 includes a lowermost point that may vary in elevation along radial directions. For example, in this embodiment, the floor 44 slopes upward from the inner surface 16*a* to the outer surface 16*b* such that an orifice 46*a* at an entry section 46 is larger than an orifice 48*a* at an exit section 48. The entry section 46 and the exit section 48 include the orifices 46*a*, 48*a* of the crenels 30 but are not limited to the orifices 46*a*, 48*a* and may include nearby parts of the floor 44. Thus, the entry and exit sections 46, 48 denote portions of the floor 44 near the orifices 46*a*, 48*a*. The floor 44 may be concavely curved and may have a constant radius of curvature. Due to the curvature of the floor 44, the direction of combustible gas near the floor 44 is different at the entry section 46 of the crenels 30, which bounds the chamber 15 of the gas burner 10, from the exit section 48 of the crenels 30, which bounds the exterior of the gas burner 10. As shown in FIG. 4, a tangent 50 to the floor 44 at the entry section 46 forms an acute angle with the horizontal plane that may be 0 or near 0 degrees. However, the acute angle at the entry section 46 need not approximate 0 degree. Meanwhile, a tangent 52 to the floor 44 at the exit section 48 forms an acute angle A with the horizontal plane that is greater than the acute angle formed at the entry section 46. In this embodiment, the acute angle A at the exit section 48 is about 48 degrees. However, the acute angle need not approximate this value and may diverge from this value. FIG. 4 shows that the floor 44 transitions to the inner surface 16*a* and the outer surface 16*b* in a rounded manner. It must be noted that these tangents 50, 52 are intended to measure the substantial direction of gas flow into the entry section 46 and out of the exit section 48. Therefore, although a tangent is determined with respect to one point on a curve, the tangents 50 and 52 are not to be measured at the rounded ends of the floor 44 and should be measured at areas of the entry and exit sections 46, 48 that are indicative of the direction of gas flow. It must be noted that, although the difference in the slope of the tangent at the entry section 46 and at the exit section 48 arises from a curvature of the floor 44 in this embodiment, the floor 44 may also be formed to have two or more flat surfaces each having a different slope so that the flat surface at the entry section 46 has a first slope and the flat surface at the exit section 48 has a second slope.

One of the benefits of the present invention is that, using this configuration of the gas ports, the flow of gas exits the gas burner in a more upward direction and the flame is directed toward an item placed above the gas burner 10 resulting in a more efficient flame that can heat the item to a predetermined level in a shorter amount of time. For example, testing showed that the boil time for about 13 pounds of water was reduced by more than one minute in this embodiment compared a floor of the crenel that had a single slope throughout. Although it is possible to increase the exit angle of gas flow in a crenel with a flat floor by simply increasing the slope of the floor, the range of possible angles that can be formed for the gas ports may be limited by factors such as the dimensions of the gas burner, the thickness of the wall, the size of the orifice at the exit portion, etc. For example, the size of the orifice at the exit portion may become too small if the gas port has a flat, linear floor and the angle is increased to the desired slope. The curved configuration of the present invention overcomes such limitations and allows a steeper exit angle of gas flow to be obtained unlike a flat, linear floor with a single slope. The curvature of the floor may be adjusted such that the angle formed by the tangent to the floor at the exit section with the horizontal plane may be increased or decreased. The angle formed by the tangent to the floor at the entry section with the horizontal plane may also be adjusted. Such adjustment of the curvature may achieve alternative effects as to the direction of gas flow of out of the chamber and heating efficacy.

The invention has been described with reference to the example embodiments described above. Modifications and alterations will occur to others upon a reading and understanding of this specification. Examples of embodiments incorporating one or more aspects of the invention are intended to include all such modifications and alterations insofar as they come within the scope of the appended claims.

What is claimed is:

1. A gas burner for an appliance, including:

a chamber peripherally defined by a wall, the wall including a plurality of ports that extend therethrough and are configured to release combustible gas exteriorly of the gas burner, the ports including an entry and an exit for combustible gas, the entry corresponding to an innermost portion of the port, the exit corresponding to an outermost portion of the port, each of the ports including a floor, the floor having a surface that continuously curves upwardly from the entry to the exit such that the floor is highest at the exit, an angle formed by a tangent to the floor and a horizontal plane being greater at the exit than at the entry.

2. The gas burner of claim 1, wherein a first acute angle formed by a tangent to the floor at the exit with a horizontal plane is greater than a second acute angle formed by the tangent to the floor at the entry with the horizontal plane.

3. The gas burner of claim 2, wherein the first acute angle is about 48 degrees.

4. The gas burner of claim 2, wherein the second acute angle is zero.

5. The gas burner of claim 1, wherein the floor is concave.

6. The gas burner of claim 1, wherein the floor has a constant radius of curvature.

7. The gas burner of claim 1, wherein the gas burner is cylindrical and the ports are radially oriented.

8. The gas burner of claim 1, wherein the ports are peripherally scattered about the gas burner.

9. The gas burner of claim 1, wherein the chamber is bounded by a base and a cover placed on the base, and the ports are adapted to direct combustible gas upward toward a heated object above the cover.

10. The gas burner of claim 1, wherein the ports are vertical slits.

11. The gas burner of claim 1, wherein the acute angle formed by a tangent to the floor with a surface on which the gas burner is mounted gradually increases from the entry point toward the exit point.

12. A gas burner for an appliance, including:

a chamber peripherally defined by a wall including an inner surface and an outer surface, the wall including a plurality of ports that extend therethrough and are configured to release combustible gas exteriorly of the gas burner, the ports including an entry point at the inner surface and an exit point at the outer surface for combustible gas, the entry point corresponding to an innermost portion of the port, the exit point corresponding to an outermost portion of the port, each of the ports including a floor, the floor having a surface that continuously curves upwardly from the entry point to the exit point such that the acute angle formed by a tangent to the floor with a surface on which the gas burner is mounted gradually increases from the entry point toward the exit point and such that the floor is highest at the exit point, the exit point defined as the intersection of the floor and the outer surface of the wall.

13. A gas burner for an appliance, including:

a base including a wall peripherally formed about the base, the wall including an inner surface, an outer surface and a plurality of slits extending through the wall; and a cover configured to be placed on the base and form a chamber in fluid communication with a gas conduit, the cover configured to bound the slits to define a plurality of ports for releasing combustible gas exteriorly of the gas burner, wherein the chamber is configured such that the combustible gas that enters through the gas conduit is confined to the chamber prior to exiting through the ports, wherein the ports include an entry adjacent the inner surface and an exit adjacent the outer surface, the entry corresponding to an innermost portion of the port, the exit corresponding to an outermost portion of the port, and wherein each of the slits includes a concave-shaped floor that is continuously curved from the entry to the exit such that the acute angle formed by a tangent to the floor with a surface on which the gas burner is mounted gradually increases from the entry point toward the exit point and such that the floor is highest at the exit.

14. The gas burner of claim 13, wherein a first acute angle formed by a tangent to the floor at the exit with a horizontal plane is greater than a second acute angle formed by the tangent to the floor at the entry with the horizontal plane.

15. The gas burner of claim 14, wherein the first acute angle is about 48 degrees.

16. The gas burner of claim 13, wherein the ports are adapted to direct combustible gas upward toward a heated object above the cover.

17. A gas burner for an appliance, including:

a base including a crenellated wall peripherally formed about the base, the wall including an inner surface and an outer surface and further including crenels and merlons arranged in an alternating manner along the wall, the crenels extending through the wall and downwardly from a top of the wall; and a cover configured to be placed on the base and form a chamber in fluid communication with a gas conduit, the cover configured to bound the crenels to define a plurality of ports for releasing combustible gas exteriorly of the gas burner, wherein the ports include an entry section and an exit section, and the crenels include a floor such that a first acute angle formed by a tangent to the floor at the exit section with a horizontal plane is greater than a second acute angle formed by the tangent to the floor at the entry section with the horizontal plane, and wherein each of the merlons includes recessed portion forming a horizontal slit extending through the wall, a first flow of gas is released through the crenels and a second flow of gas is released through the horizontal slits.

18. The gas burner of claim 17, wherein the floor is concave.

19. The gas burner of claim 17, wherein the first acute angle is about 48 degrees.

20. The gas burner of claim 17, wherein the crenels extend vertically.

21. The gas burner of claim 17, wherein the recessed portion is beveled near the inner face to define an entry area of the horizontal slit.

22. The gas burner of claim 17, wherein the crenels are adapted to direct combustible gas upward toward a heated object above the cover.

* * * * *